US005291688A

United States Patent [19]

Pederson

[11] Patent Number: 5,291,688

[45] Date of Patent: Mar. 8, 1994

[54] ADJUSTABLE DOOR ASSEMBLY

[76] Inventor: Robert D. Pederson, 312 Duenow St., Athens, Wis. 54411

[21] Appl. No.: 14,756

[22] Filed: Feb. 8, 1993

[51] Int. Cl.[5] ..... E06B 3/00

[52] U.S. Cl. ..... 49/501; 52/823

[58] Field of Search ..... 49/124, 501; 52/217, 52/243.1, 475, 406, 821, 823, 824, 826, 782, 811, 813, 814, 815, 816, 822; 16/277

[56] References Cited

U.S. PATENT DOCUMENTS

| | | | |
|---|---|---|---|
| 2,323,625 | 7/1943 | Seaman | 52/823 X |
| 3,141,206 | 7/1964 | Stephens | 52/406 X |
| 3,413,762 | 12/1968 | Baude | 49/501 |
| 4,091,593 | 5/1978 | Mennuto | 52/826 X |
| 4,680,903 | 7/1987 | Horgan | 52/826 X |
| 4,706,422 | 11/1987 | Ashton | 52/822 X |

*Primary Examiner*—Peter M. Cuomo
*Assistant Examiner*—Jerry Redman
*Attorney, Agent, or Firm*—Leon Gilden

[57] ABSTRACT

A door assembly is arranged for accomodating adjustment relative to a door frame, with the organization including a door including first and second end wall caps mounted to the first and second ends of the door, wherein the caps are arranged for pivoted adjustment relative to the first and second door ends. Further, a latch member is arranged for longitudinal adjustment about a side of the door.

7 Claims, 4 Drawing Sheets

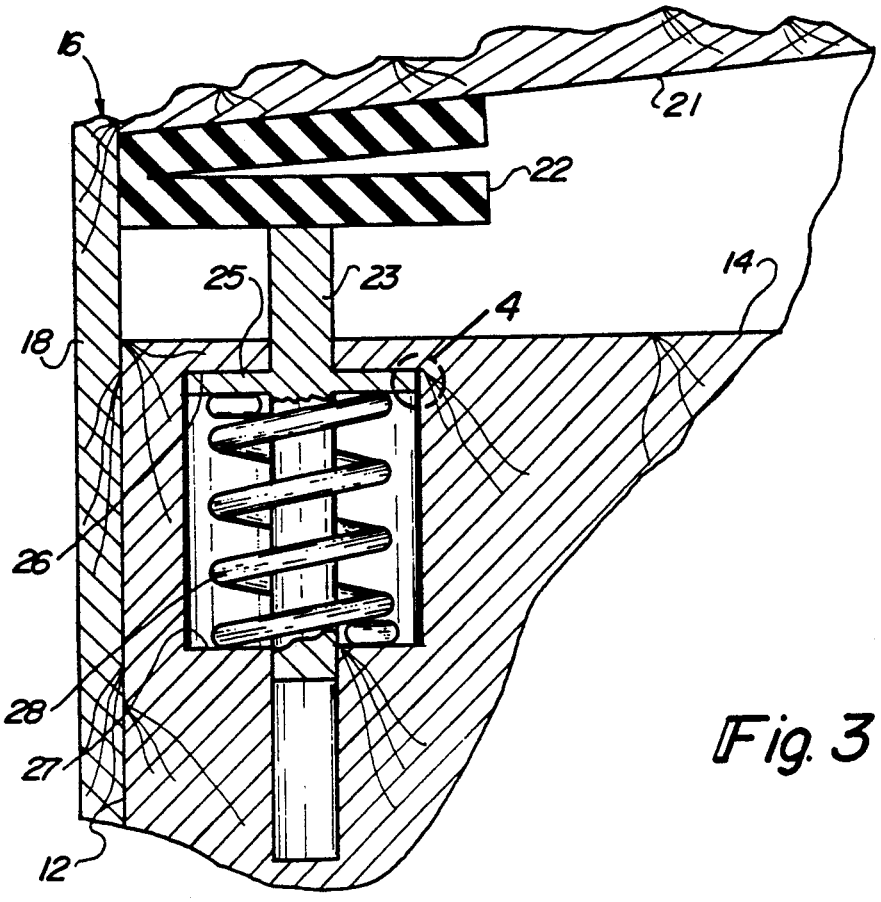
Fig. 3
Fig. 4
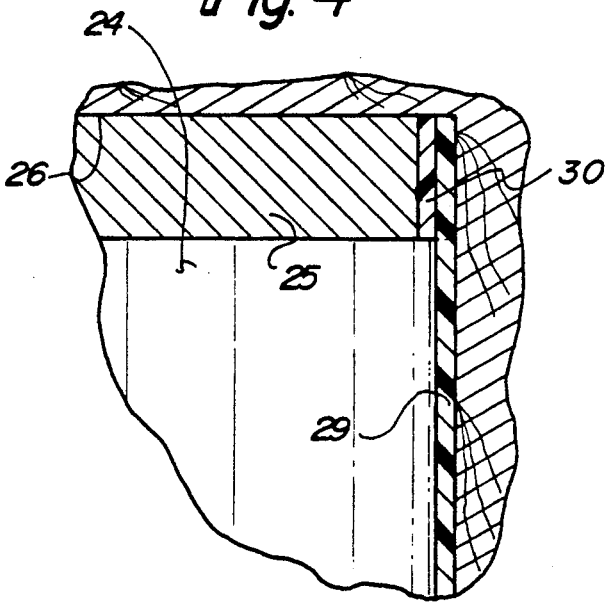

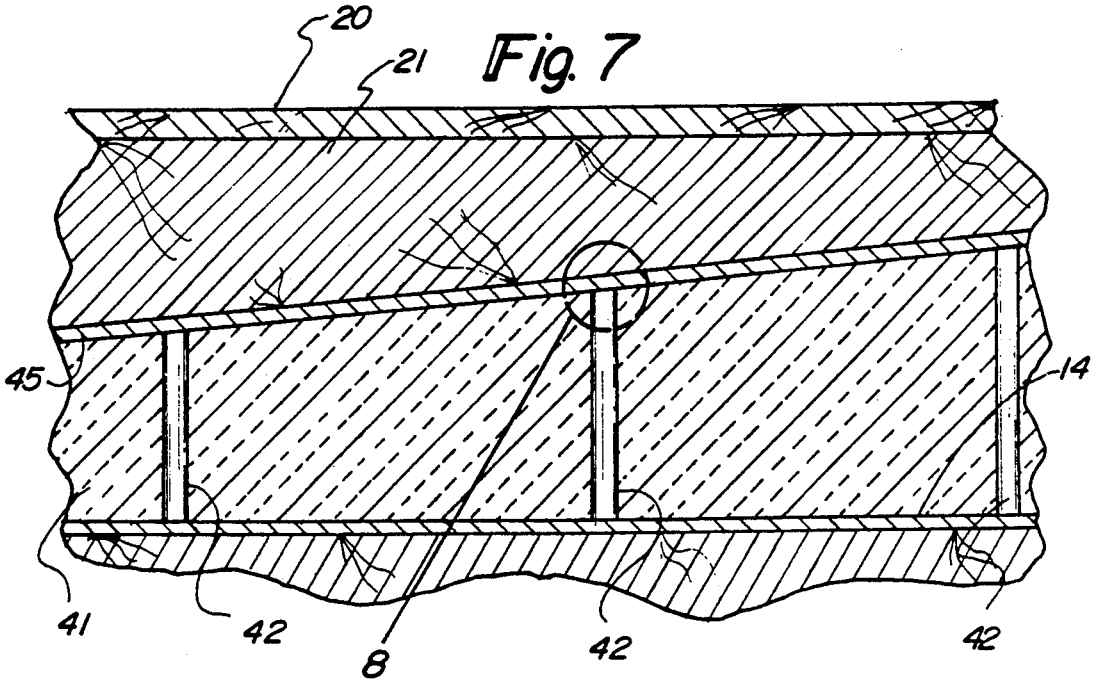
Fig. 7
Fig. 8
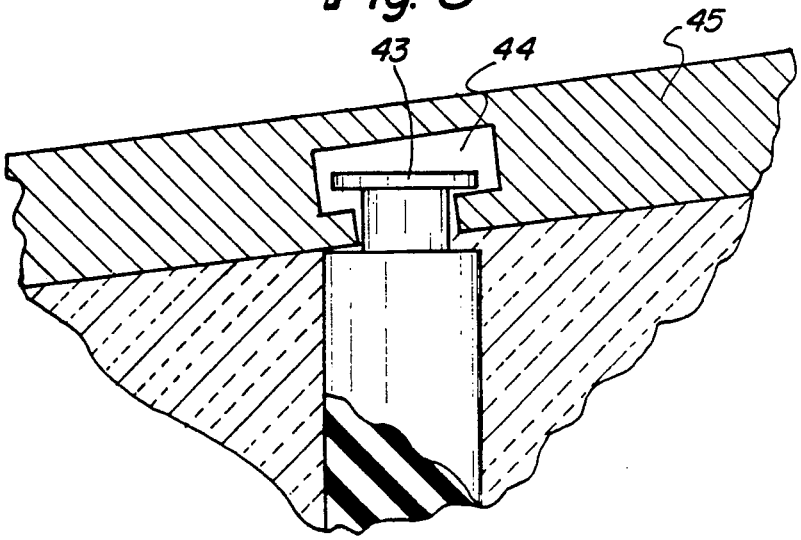

ADJUSTABLE DOOR ASSEMBLY

BACKGROUND OF THE INVENTION

1. Field of the Invention

The field of invention relates to adjustable door structure, and more particularly pertains to a new and improved adjustable door assembly wherein the same is directed to the accommodating of various configurations within a door frame.

2. Description of the Prior Art

Such structure relative to adjustment of door members within a door frame are typically directed by the adjustment of the frame relative to the door, wherein such adjustable frame structure is directed in U.S. Pat. Nos. 3,571,995; 4,912,879; 4,986,034; and 4,986,044.

The instant invention attempts to overcome deficiencies of the prior art by providing for a door member that is adjustable relative to a fixed rigid door frame structure and in this respect, the present invention substantially fulfills this need.

SUMMARY OF THE INVENTION

In view of the foregoing disadvantages inherent in the known types of door structure now present in the prior art, the present invention provides an adjustable door assembly wherein the same employs cap members adjustably mounted to the first and second ends of an associated door for adjustment of the door in combination of frame variations relative to the door. As such, the general purpose of the present invention, which will be described subsequently in greater detail, is to provide a new and improved adjustable door assembly which has all the advantages of the prior art door structure and none of the disadvantages.

To attain this, the present invention provides a door assembly arranged for accommodating adjustment relative to a door frame, with the organization including a door including first and second end wall caps mounted to the first and second ends of the door, wherein the caps are arranged for pivoted adjustment relative to the first and second door ends. Further, a latch member is arranged for longitudinal adjustment about a side of the door.

My invention resides not in any one of these features per se, but rather in the particular combination of all o f them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable door assembly which has all the advantages of the prior art door structure and none of the disadvantages.

It is another object of the present invention to provide a new and improved adjustable door assembly which may be easily and efficiently manufactured and marketed.

It is a further object of the present invention to provide a new and improved adjustable door assembly which is of a durable and reliable construction.

An even further object of the present invention is to provide a new and improved adjustable door assembly which is susceptible of a low cost of manufacture with regard to both materials and labor, and which accordingly is then susceptible of low prices of sale to the consuming public, thereby making such adjustable door assemblies economically available to the buying public.

Still yet another object of the present invention is to provide a new and improved adjustable door assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexèd to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an enlarged orthographic view of section 3 as set forth in FIG. 2.

FIG. 4 is an enlarged orthographic view of section 4 as set forth in FIG. 3.

FIG. 7 is an orthographic cross-sectional illustration of the door cap structure employing a resilient insulative filler material.

FIG. 8 is an enlarged orthographic view of section 8 as set forth in FIG. 7.

DESCRIPTION OF THE PREFERRED EMBODIMENT

Figure 1:
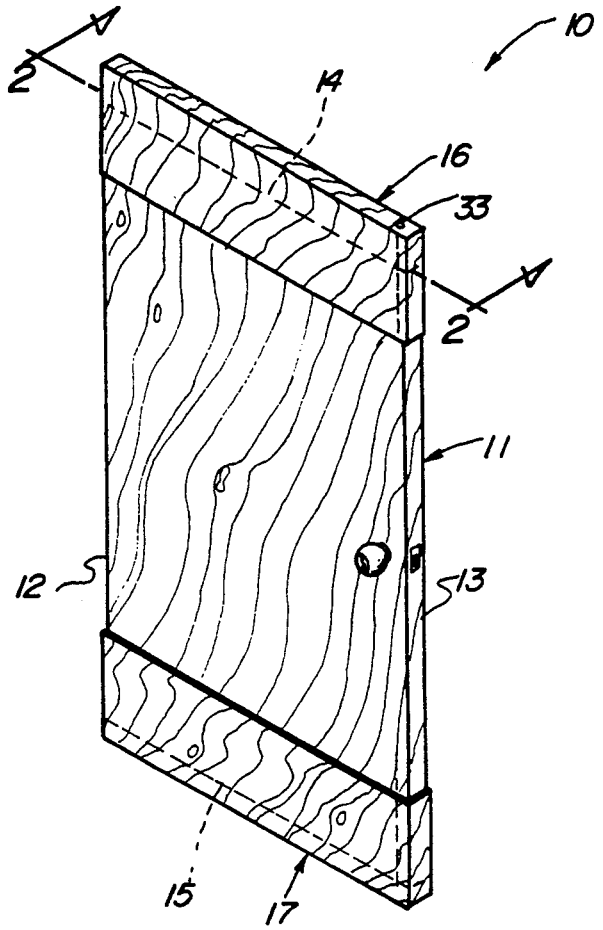
FIG. 1 is an isometric illustration of the invention.
Figure 2:
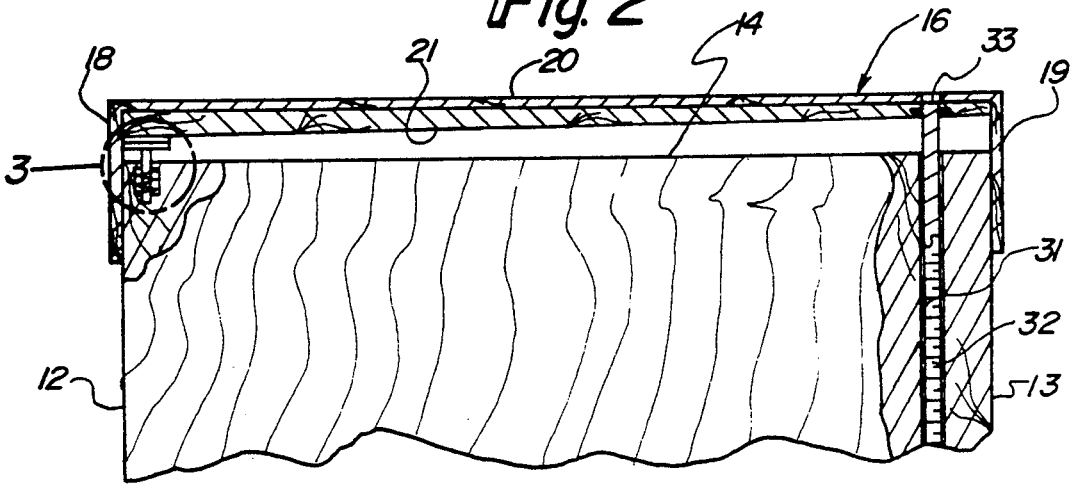
FIG. 2 is an orthographic view, taken along the lines 2—2 of FIG. 1 in the direction indicated by the arrows.

With reference now to the drawings, and in particular to FIGS. 1 to 8 thereof, a new and improved adjustable door assembly embodying the principles and concepts of the present invention and generally designated by the reference numeral 10 will be described.

More specifically, the adjustable door assembly 10 includes a rigid door 11, having a first side wall 12 spaced from a second side wall 13, with a first end wall 14 spaced from a second end wall 15, wherein typically the first and second end walls 14 and 15 respectively are orthogonally oriented relative to the first and second side walls 12 and 13. The first and second end walls 14 and 15 include respective first and second end wall cap members 16 and 17 slidably received over the rigid door about the first and second end walls 12 and 13. The caps are of identical construction, wherein description of the first end wall cap 16 is to be understood as applicable to the second end wall cap 17.

The first end wall cap 16 includes cap first and second end walls 18 and 19 arranged for reception of the respective first and second side walls 12 and 13 of the door 11. A cap floor plate 20 is arranged to include a floor plate canted interior surface 21 arranged to extend from the cap first end wall 18 to the cap second end wall 19 of a first thickness adjacent the first end wall 18 to a second thickness adjacent the second end wall 19, wherein the first thickness is greater than the second thickness. The canted door structure permits pivoting of the cap first end wall 18 relative to the door first side wall 12 projecting the cap second end wall 19 over the door second side wall 13. It is to be understood that the clearances of the cap relative to the door 11 permit the pivoting relationship as indicated. The apparatus includes a hinge web 22 having hinged plate members, including a first plate member mounted to the canted interior surface 21 adjacent the cap first end wall 18, with a second plate member mounted to a hinge rod 23, that in turn is orthogonally and slidably received through the door first end wall 14 in adjacency to the door first side wall 12. A rod cavity 24 slidably receives a rod 23 therethrough, with the rod 23 having an abutment plate 25 fixedly mounted to the rod within the cavity 24. The cavity 24 includes a cavity roof 26 spaced from a cavity floor 27, with a spring member 28 interposed between the abutment plate 25 and the cavity floor 27. In this manner, hinged orientation of the cap 16 is availed relative to the door first end wall 14. Further, a cavity bearing strip 29 positioned within the cylindrical side wall of the cavity 24 is arranged for cooperation with an abutment plate bearing strip 30. The strips 29 and 30 are typically formed of TEFLON or any suitable sliding bearing substance.

An internally threaded bore 31 is directed into the first end wall 14, as well as into the second end wall 15, each to receive an externally threaded adjustment rod 32, having an adjustment rod head 33 rotatably mounted within the floor plate 20 and the interior surface 21. In this manner, threaded projection of the adjustment rod 32 into the internally threaded bore 31 directs either the first or second end wall cap 16 or 17 into the respective first and second end wall 14 and 15 about an associated bifurcated hinge web 22.

Figure 5:
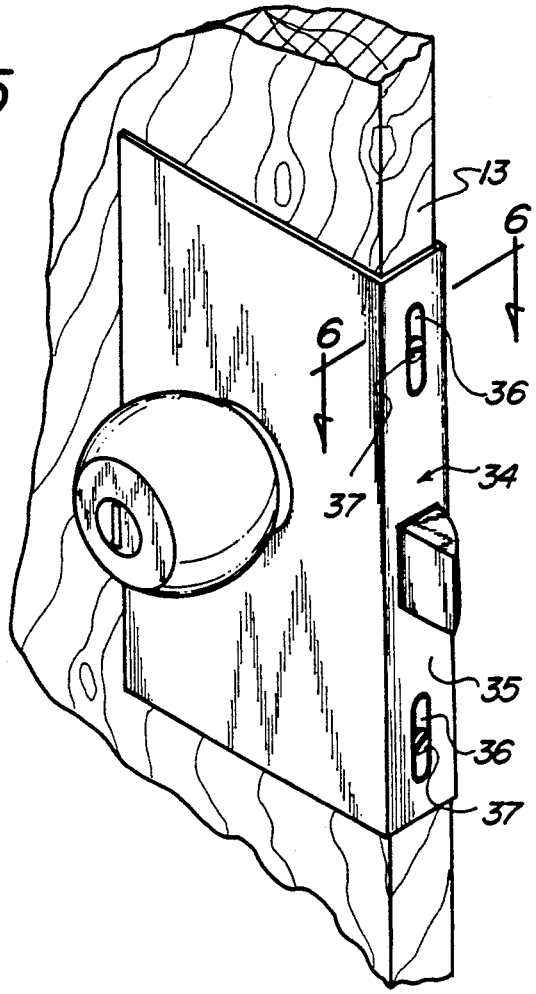
FIG. 5 is an isometric view of the adjustable lock plate structure of the invention.
Figure 6:
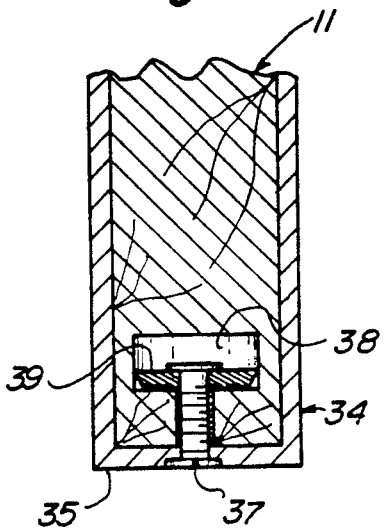
FIG. 6 is an orthographic view, taken along the lines 6—6 of FIG. 5 in the direction indicated by the arrows.

FIGS. 5 and 6 indicate the lock plate structure 34 optionally employed by the invention arranged for slidable adjustment longitudinally of the door second side wall 13. The lock plate 34 includes an end wall 35 in contiguous sliding communication with the door second side wall 13, with the lock plate end wall 35 having a plurality of longitudinally aligned slots 36, each including an end wall fastener 37 orthogonally directed through the end wall through an associated slot 36, with each end wall fastener 37 received within an end wall fastener cavity 38 within the door structure in adjacency to the second side wall 13 of the door 11. The fastener cavities 38 are substanstially coextensive relative to the slots 36, with a fastener cavity lock plate 39 slidably mounted within each fastener cavity 38 threadedly receiving an associated fastener 37 therewithin. In this manner, loosening of the fasteners 37 permits sliding of the lock plate structure 34 relative to the door 11.

The FIGS. 7 and 8 indicates the use of a compressible polymeric foam core 41 functioning as an insulative and spring material directed coextensively between the door end walls 14 and 15 relative to the associated interior surfaces 21. A plurality of resilient polymeric columns 42 are orthogonally mounted between the door end walls 14 and 15 and the associated interior surfaces and are arranged to include a rigid stress plate 45 mounted coextensively to the canted interior surface 21 to distribute force from the resilient polymeric columns 42 evenly relative to each respective cap. Each of the columns 42 is indicated to include a column first end 43 rotatably and pivotally mounted within a first end cavity 44 within the stress plate 45. The columns second ends are arranged for contiguous communication and mounting to the associated door end walls. In this manner, biasing of the caps are provided, as well as functioning as an insulative barrier relative to each of the cap structures 16 and 17.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable door assembly, comprising, a rigid door, having a first side wall spaced from a second side wall, and a first end wall spaced from a second end wall, and at least the first end wall including a cap member mounted to the first end wall, wherein the cap member includes a cap first end wall in adjacency to the first side wall and a cap second end wall in adjacency to the door second side wall, and the cap having a cap floor plate positioned in a spaced relationship above the door first end wall, and hinge means mounted to the door first end wall and to the floor plate for pivotally mounting the cap member relative to the door, and the floor plate includes a canted interior surface arranged in facing confronting relationship relative to the door first end wall, wherein the interior surface extends from the cap first end wall to the cap second end wall and is of a first thickness at the cap first end wall and a second thickness at the cap second end wall, wherein the second thickness is less than the first thickness, and the hinge means includes a bifurcated hinge web having a first hinge plate secured to the canted interior surface, and a hinge rod, with the hinge rod having a second plate hingedly mounted to the hinge rod, the hinge rod is orthogonally and slidably directed through the door first end wall.

2. A door assembly as set forth in claim 1 including a rod cavity positioned in adjacency to the door first side wall and the door first end wall slidably receiving the hinge rod therethrough, and the hinge rod having an abutment plate positioned within the rod cavity, wherein the rod cavity includes a roof spaced from a cavity floor, with the abutment plate arranged in adjacency to the floor, and a spring member captured between the abutment plate and the cavity floor wound about the hinge rod to bias the hinge rod in a projecting relationship relative to the door first end wall.

3. A door assembly as set forth in claim 2 wherein the abutment plate includes an annular bearing strip coextensive to an annular periphery of the abutment plate, and the rod cavity includes a rod cavity interior cylindrical side wall having a side wall bearing strip arranged for contiguous communication with the plate bearing strip.

4. A door assembly as set forth in claim 3 including an internally threaded bore orthogonally directed into the door extending from the first end wall, and an externally threaded adjustment rod having threaded engagement with the internally threaded bore, the adjustment rod including a rod head rotatably mounted within the floor plate and canted interior surface and directed through the door plate for access to permit rotation of the adjustment rod relative to the internally threaded bore, and adjustment of the floor plate and canted interior surface relative to the door first end wall.

5. A door assembly as set forth in claim 4 including a lock plate, the lock plate having a lock plate end wall arranged for sliding engagement with the door second side wall, the lock plate having end wall slots longitudinally aligned directed through the lock plate end wall, and each of the end wall slots including an end wall fastener orthogonally directed through the lock plate end wall projecting into the rigid door through the door second side wall, and each fastener received within a fastener cavity, and each fastener cavity including a fastener cavity lock plate threadedly receiving the fastener for threaded securement of the lock plate relative to the door second side wall.

6. A door assembly as set forth in claim 5 including a compressible polymeric foam core mounted coextensively between the canted interior surface and the door first end wall.

7. A door assembly as set forth in claim 6 wherein the compressible polymeric core includes a plurality of spaced parallel resilient polymeric columns, each of the columns orthogonally oriented relative to the door first end wall, and each of the columns includes a column first end, and a rigid stress plate mounted coextensively to the canted interior surface in confronting relationship relative to the resilient polymeric columns, and each of the column first end is rotatably mounted in a pivotal relationship relative to the stress plate, and each polymeric column includes a second end in contiguous communication with the door first end wall.

* * * * *